US006371081B1

(12) United States Patent
Hawkins et al.

(10) Patent No.: US 6,371,081 B1
(45) Date of Patent: Apr. 16, 2002

(54) INHIBIT ENGINE SPEED GOVERNOR

(75) Inventors: Jeffery Scott Hawkins, Farmington Hills; Richard Michael Avery, Jr., West Bloomfield; Donald Michael McDonald, Howell, all of MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/675,925

(22) Filed: Sep. 29, 2000

(51) Int. Cl.[7] ..... F02D 41/14; F02D 31/00
(52) U.S. Cl. ..... 123/352; 123/339.14; 701/110
(58) Field of Search ..... 123/350, 352, 123/396, 339.14, 339.1; 701/54, 84, 93, 110

(56) References Cited

U.S. PATENT DOCUMENTS 4,853,720 A * 8/1989 Onari et al. ..... 364/431.07
5,036,814 A * 8/1991 Osawa et al. ..... 123/352
5,553,589 A * 9/1996 Middleton et al. ..... 123/352
6,085,725 A * 7/2000 Goode et al. ..... 123/357
6,104,976 A * 8/2000 Nakamura ..... 701/95
6,119,063 A * 9/2000 Hieb et al. ..... 701/110
6,134,499 A * 10/2000 Goode et al. ..... 701/93

FOREIGN PATENT DOCUMENTS

JP 269384 * 10/1995 ..... F02D/29/00

* cited by examiner

*Primary Examiner*—Tony M. Argenbright
*Assistant Examiner*—Hai Huynh
(74) *Attorney, Agent, or Firm*—Brooks & Kushman P.C.

(57) ABSTRACT

An engine controller capable of operating in both a torque governing mode and a speed governing mode simultaneously, and a method of operation whereby speed governing may be enabled and disabled while simultaneously providing a valid speed request signal to the controller is disclosed. A speed governor signal having an enabled state and a disabled state is generated external to the controller and monitored by the speed governor. A speed request signal is simultaneously monitored by the speed governor. The speed governor is operative to control the speed of the engine proportional to the speed request signal while the speed governor signal is in the enabled state. The speed governor is disabled by setting the speed governor signal into the disabled state. A torque governor may also be operational within the controller. The torque governor monitors a torque request signal which it uses to control a torque generated by the engine.

16 Claims, 2 Drawing Sheets

INHIBIT ENGINE SPEED GOVERNOR

TECHNICAL FIELD

The present invention is related to the field of governing functions of engine controllers.

BACKGROUND ART

Internal combustion engines may be operated in any one of several modes including user controlled, torque governed, and speed governed. User control is the most common mode where the user operates a foot pedal to request an amount of torque that the engine will generate. Increasing the requested torque generally causes an increase in the speed of the engine. User control relies upon the user to adjust the requested torque to account for variations in the loading upon the engine.

Torque governing is often used in conjunction with the user control to limit the amount of torque that the user may request of the engine. For example, it is desirable to limit the amount of torque an engine may produce to match the characteristics of an associated transmission. Torque limiting may be a simple maximum limit at all speeds, or vary as a function of the engine speed. Here, the idea is to avoid supplying more torque into the transmission or load than the transmission or load can handle. As the load on the engine increases, the engine speed is allowed to decrease under torque governing to avoid exceeding the maximum torque limit. As the load decreases, the engine speed is allowed to increase, again within the maximum speed and torque limits imposed by the governors.

Speed governing is used in situations where the speed of the engine must remain a constant despite a changing load condition. Examples of such applications include alternating current electrical generators where the frequency of the alternating current is dependent upon the engine speed. In this example, as the load on the generator increases, the torque produced by the engine must increase in order to maintain the constant engine speed, and thus a constant generator output frequency. The desired speed of the engine is controllable through a speed request signal input into the speed governor.

Many engine applications require the engine to operate in one or more of these modes at different times, and sometimes simultaneously. For example, a self-propelled highway-compatible crane operates in the torque governing mode when traveling on the highways. Once at a job site, the crane's engine is operated in the speed governing mode for proper operation of the crane. When returning to highway travel, the user requires a convenient and reliable mechanism that insures that the speed governing mode is disabled and that the torque governing mode is enabled. One method currently in use to disable speed governing is to set the speed request signal to an out-of-range value. The speed governor will not control the engine speed without a valid speed request signal input. A drawback to this approach is that the speed governor may flag the out-of-range speed request signal as a failure. The users must either be taught to ignore this failure, or the diagnostics for this type of failure must be disabled. What is desired is an approach where the speed governor can be easily enabled and disabled while still accepting a valid speed request signal.

DISCLOSURE OF INVENTION

The present invention is an engine controller capable of operating in both a torque governing mode and a speed governing mode simultaneously, and a method of operation whereby speed governing may be enabled and disabled while simultaneously providing a valid speed request signal to the controller. A speed governor signal having an enabled state and a disabled state is generated external to the controller and monitored by the speed governor. A speed request signal is simultaneously monitored by the speed governor. The speed governor is operative to control the speed of the engine proportional to the to speed request signal while the speed governor signal is in the enabled state. The speed governor is disabled by setting the speed governor signal into the disabled state. A torque governor may also be operational within the controller. The torque governor monitors a torque request signal which it uses to control a torque generated by the engine.

In alternative embodiments, the speed governor is disabled when the speed request signal is out-of-range, either in excess of a high speed threshold, or below a low speed threshold. Likewise, the speed governor may be disabled when the torque request signal exceeds a high torque threshold indicating that the user wishes to override the speed governor and increase the engine's torque production.

Transitioning the speed governor from disabled to enabled may also be dependent upon the speed request signal and/or torque request signal. In alternative embodiments, speed governor enablement may be restricted to occur only when the speed request signal is below an initial speed threshold to avoid a large sudden step in the requested speed. Likewise, speed governing enablement may by restricted to occur only when the torque request signal is below an initial torque threshold.

Accordingly, it is an object of the present invention to provide an engine controller and a method of operation whereby a speed governor of the controller can be easily enabled and disabled while maintaining a valid speed request signal.

These and other objects, features and advantages will be readily apparent upon consideration of the following detailed description in conjunction with the accompanying drawings.

BEST MODE FOR CARRYING OUT THE INVENTION

Figure 1:
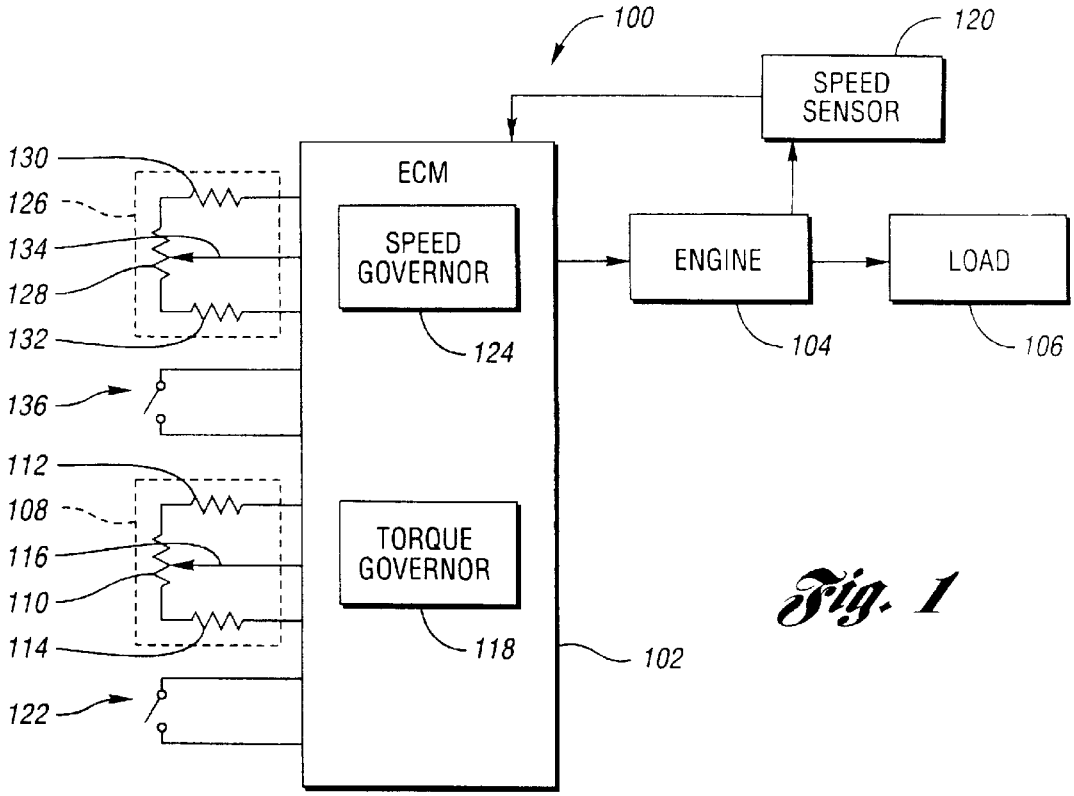
FIG. 1 is a functional block diagram of a system implementing the present invention.

FIG. 1 is a block diagram of an example system 100 that implements the present invention. An electronic control module (ECM) 102 is connected to a series of sensors (not shown) and actuators (not shown) associated with an engine 104. By monitoring the sensors and controlling the actuators, the ECM 102 controls operations of the engine 104. Under normal operations, control of the engine 104 involves controlling the amount of fuel provided to the engine 104. This in turn controls the amount of torque produced by the engine 104 and ultimately delivered to a load 106 connected to the engine 104.

The amount of torque requested of engine 104 is typically established by a torque throttle 108. Normally, the torque throttle 108 is a foot pedal type device operated by a user (not shown). Other types of torque throttles, such as a hand throttle, may be used within the scope of the present invention. In the preferred embodiment, torque throttle 108 is an electronic transducer that converts a physical displacement into an electronic signal called a torque request signal. In particular, torque throttle 108 comprises a potentiometer 110 in series between two resistors 112 and 114. The ECM 102 applies a bias voltage across the torque throttle 108 and monitors the torque request signal on a wiper 116 of the potentiometer 110. The two resistors 112 and 114 are included to prevent the torque request signal from intentionally reaching the full bias voltage or sensor ground under normal operating conditions. In the preferred embodiment, the full bias voltage is five volts direct current while a valid range for the torque request signal is between 0.5 volts and 4.5 volts. Using this method, diagnostic checks can be performed on the torque throttle 108 to detect a short to sensor ground and a short to bias voltage since they are invalid torque request signal values. Other types of sensors may be used within the scope of the present invention including , but not limited to, rotary variable differential transformers, linear variable differential transformers, optical encoder and the like. In alternative embodiments, the torque throttle 108 may be electrically connected to an electronics unit (not shown) other than the ECM 102. The ECM 102 then receives the torque request signal via discrete wiring, digital bus, or other communications link established with the other electronics unit.

Functionality of a torque governor 118 is provided by the ECM 102 to adjust the raw torque request signal received from the torque throttle 108 prior to using it to control the engine 104. In particular, the torque governor 118 sets upper and lower limits on the amount of torque that may be requested of the engine 104. These limits are established based upon the requirements and capabilities of the load 106 to accept torque from the engine 104 and/or mechanical limits of the engine 104. itself. For example, in configurations where the engine 104 can produce more torque than the load 106 can accept, torque governor 118 adjusts the torque request signal such that the load's torque limits are not exceeded even at a 100% torque request signal. At the other extreme, a lower requested torque limit is established by the idle speed of engine 104. The torque governor 118 should be operational to maintain the engine 104 at no less than idle speed to prevent the engine from stalling.

In another example of torque governing, the engine 104 may be part of a truck operating on a highway with the user desiring to operate the engine 104 at a steady, user selected amount of torque. In this case, the torque governor's function is to hold the amount of torque produced by the engine 104 at the user selected amount. Should the truck encounter an uphill grade, then the speed of the engine 104 will slow down as the amount of torque produced by engine 104 remains unchanged. Conversely, engine speed will increase on downhill grades as the load on the engine 104 decreases.

A speed sensor 120 may be attached to the engine 104 to provide an engine speed signal back to the ECM 102 and torque governor 118. The engine speed signal may be used by the torque governor 118 in situations where the load's torque limit is dependent upon the rotational speed of its input shaft.

A torque throttle inhibit switch 122 may be provided to enable and disable operation of the torque governor 118. An enabled torque governor 118 operates as described above. When the torque governor is disabled, the ECM 102 controls the engine 104 to an idle speed. The ability to idle the engine 104 when the torque governor 118 is disabled is useful in certain situations. It is desirable in some applications to prevent the engine 104 from responding to a large torque request from the user at inopportune moments. For example, the torque throttle inhibit switch 122 may be sensitive to an open/closed state of a door on a bus that incorporates engine 104. As long as the bus door is open, the torque governor 118 is disabled, the engine 104 remains at idle, and the bus driver cannot move the bus. When the bus door is closed then the torque governor 118 is enabled and responsive to torque request signals from the bus driver.

For normal use, the torque governor 118 is enabled when a switch contact of the torque throttle inhibit switch 122 is open (throttle inhibit switch 122 is in the enabled state), and the torque governor 118 is disabled then the switch contact of the torque throttle switch 122 is closed (throttle inhibit switch 122 is in the disabled state). In this arrangement a failure of the torque throttle inhibit switch 122 to close will not lock engine 104 into an idle condition. In the above example this means that the bus may still be driven even with the failure present. Where failing in the opposite state is important, the torque throttle inhibit switch 122 may be arranged to be in the enabled state when the switch contact is closed, and in the disabled state when the switch contact is open. Now, a failure resulting in the switch contact being stuck open will disable the torque governor 118 thus causing the engine 104 to remain at idle until the failure is repaired.

Functionality of a speed governor 124 is also provided by the ECM 102. Speed governor 124 provides control of the engine 104 to maintain the engine's speed at a constant value. The constant value is proportional to a speed request signal generated externally to the ECM 102. The speed request signal may be user controlled, or may be a fixed value calculated to produce a desired rotational speed at the power take-off of engine 104. Speed governor 124 requires feedback from the speed sensor 120 to account for loading variations induced on engine 104 by the load 106. As load 106 draws more power from engine 104, speed governor 124 increased the amount of fuel supplied to engine 104 to maintain the engine speed. An upper limit on the torque produced by engine 104 may be imposed by torque governor 118 operating simultaneously with speed governor 124, by limits built into the speed governor 124, or by mechanical limitations of the engine 104 itself. As load 106 draws less power from engine 104, speed governor 124 decreases the amount of fuel supplied to engine 104. Friction and internal power demands of the engine 104 establish a minimum amount of fuel that the speed governor 124, torque governor 118, or an idle governor (not shown) must supply to the engine 104 to avoid stalling the engine 104.

The speed governor 124 receives a speed request signal from a speed throttle 126 connected to the ECM 102. Speed throttle 126 may be a foot pedal type device similar to the torque throttle 108 used for generating the torque request signal. Other types of speed throttles 126 include, but are not limited to a hand type throttle, a voltage divider for fixed engine speed applications, a frequency input signal proportional to the requested engine speed, and the like.

In the preferred embodiment, a user adjustable speed throttle 126 comprises a potentiometer 128 in series between two resistors 130 and 132. The ECM 102 applies a bias voltage across the speed throttle 126 and monitors the speed request signal on a wiper 134 of potentiometer 128. The two resistors 130 and 132 are included to prevent the torque request signal from intentionally reaching the full bias voltage or sensor ground under normal operating conditions. With the ECM 102 providing a five volt direct current bias, resistors 130 and 132 are selected to produce a valid range of 0.5 to 4.5 volts for the speed request signal. As with the torque throttle 108, this method allows diagnostic checks to be performed on the speed throttle 126 to detect a short to sensor ground and a short to bias voltage that result in invalid speed request signal values. Other types of sensors may be used within the scope of the present invention including , but not limited to, rotary variable differential transformers, linear variable differential transformers, optical encoder and the like. In alternative embodiments, the speed throttle 126 may be electrically connected to an electronics unit (not shown) other than the ECM 102. The ECM 102 then receives the speed request signal via discrete wiring, digital bus, or other communications link from the other electronics unit.

Figure 2:
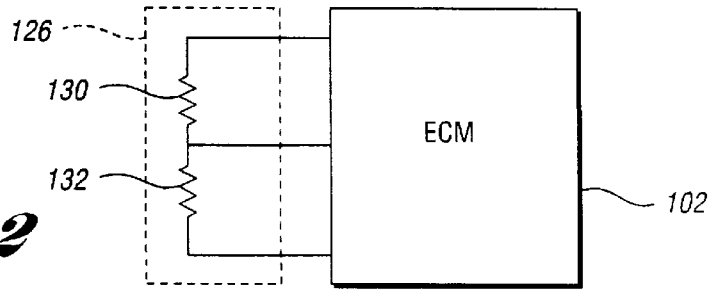
FIG. 2 is an alternative embodiment implementing a fixed speed request signal.

Referring to FIG. 2, the speed request signal can be set at a fixed value by eliminating potentiometer 128 within the speed throttle 126. In this case, the ECM 102 monitors the voltage between the two resistors 130 and 132 as the speed request signal. Here, the speed request signal is established by the fixed resistance values of the two resistors 130 and 132 and the bias voltage provided by the ECM 102. This approach is useful in applications where the load 106 requires a constant input shaft rotational speed. For example, an alternating current electrical generator requiring a fixed output frequency, or a pump requiring a constant output flow rate need their input shaft speed to remain constant.

Returning to FIG. 1, a speed throttle inhibit switch 136 may also connected to the ECM 102. Speed throttle inhibit switch 136 produces a speed governor signal that has an enabled state and a disabled state used in enabling and disabling the speed governor 124. In the preferred embodiment, the speed governor signal is in the enabled state when the switch contact of the speed throttle inhibit switch 136 is open. The disabled state for the speed governor signal is defined as the switch contact closed. In alternative embodiments, these two states may be reversed so that the speed governor signal is in the enabled state when the switch contact is closed.

Figure 3:
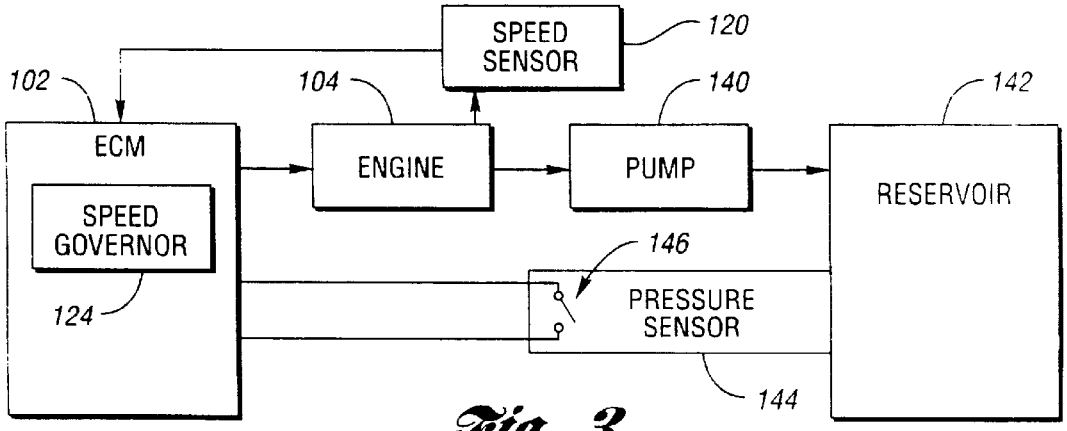
FIG. 3 is a functional block diagram of a fluid pump application.

Speed governor 124 operates as described above when enabled. When disabled, speed governor 124 ceases to control the speed of engine 104. In the absence of some other throttle controlling request, the disabled speed governor 124 will result in the engine 104 slowing to idle speed. This capability may be useful in applications where load 106 is capable exceeding some threshold imposed for practical or safety reasons. Referring to FIG. 3, load 106 may be a fluid pump 140 that fills a reservoir 142. A pressure sensor 144 senses a pressure inside reservoir 142 and provides a normally-open contact 146. Contact 146 is wired to the ECM 102 as the speed throttle inhibit switch 136. When the pressure inside the reservoir 142 reaches a predetermined threshold, the normally-open contact 146 of pressure sensor 144 closes causing the speed governor 124 to become disabled. At this point, engine 104 slows to idle speed causing fluid pump 140 to slow.

Torque governor 118 and speed governor 124 may be operational simultaneously. Simultaneous operations requires a conflict resolution scheme when the two governors 118 and 124 attempt to control the engine 104 differently. Normally, the governor with the greatest fuel request is controlling. Under fault conditions, one governor will have primary control and the other governor will have secondary control. The choice of which governor is primary and which governor is secondary is dependent upon application requirements.

Figure 5:
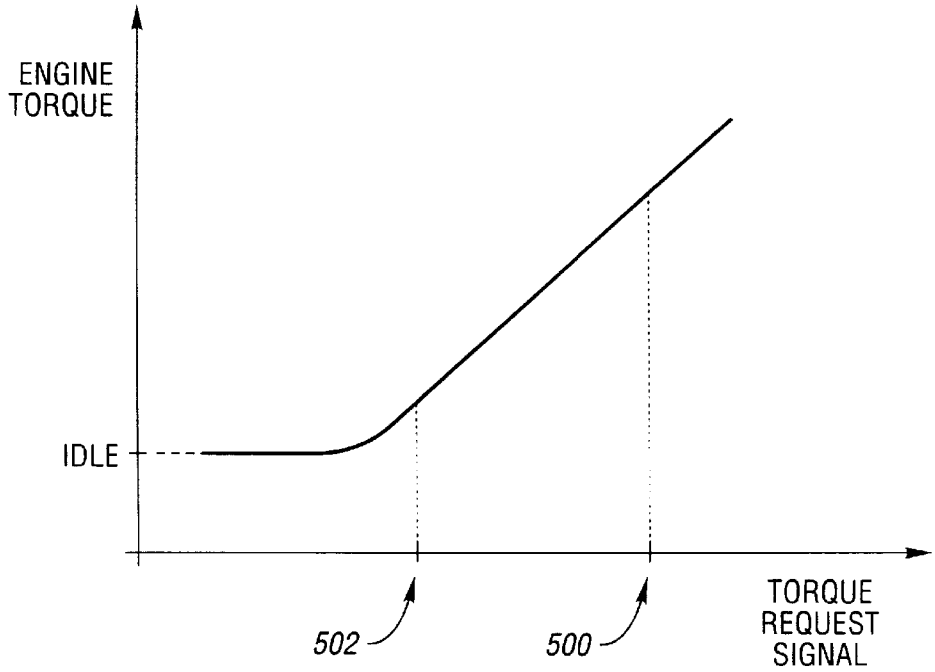
FIG. 5 is a graph of engine torque as a function of a torque request signal.

By way of example, torque governor 118 may take engine control away from the speed governor 124 in response to the user requesting an increased torque. This will allow the user to override the speed governor 124 from the torque throttle 108. In this example, the torque request signal is in communications with the speed governor 124 as well as the torque governor 118. When the torque request signal exceeds a high torque threshold (point 500 in FIG. 5), then the speed governor 124 is disabled allowing the engine 104 to increase rotational speed in response to the increased torque request signal.

Selection of the high torque threshold 500 is application dependent. For on-highway truck applications and motor coach applications, the speed governor 124 is disabled for any torque request signal at or above 4% throttle, or the idle throttle. In these applications, the user's request for increased torque production has higher priority than maintaining the engine 104 at a constant speed. When the user increased the torque request signal above idle, the speed governor 124 is disabled and the ECM 102 commands the engine 104 to increase toque proportional to the torque request signal. In other applications, such as transit busses and fire trucks, the speed governor 124 is disabled when the torque request signal reaches 100% throttle. Still other applications will require the high torque threshold 500 to be set at other values between zero percent and 100% throttle.

Figure 4:
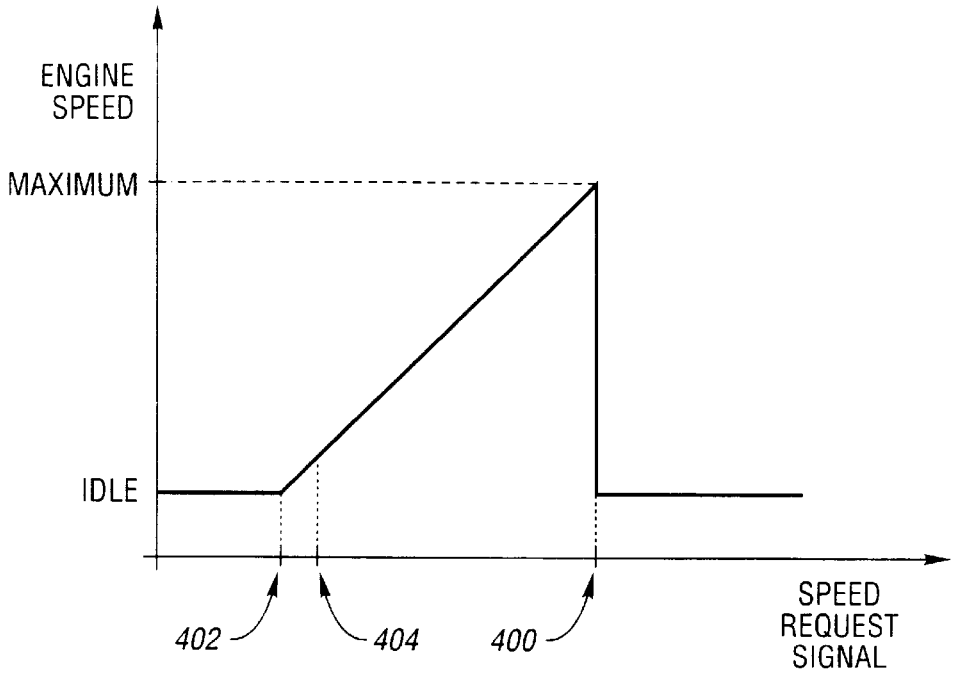
FIG. 4 is a graph of engine speed as a function of a speed request signal.

Speed governor 124 may be disabled by diagnostic routines executed by the ECM 102. In the event that the diagnostic routines detect an error that would prevent the speed governor 124 from operating properly, or an error that indicates that the speed governor 124 is in fact operating improperly, then the speed governor 124 will be disabled. An example of a detectable error that would prevent proper operation is an out-of-range speed request signal. Referring to FIG. 4, should the speed request signal exceed a high speed threshold, point 400 on the graph, then the speed governor 124 will be disabled and the engine speed returned to idle. This capability is intended to prevent an over-speed condition for the engine 104 and/or load 106. Likewise, should the speed request signal fall below a low speed threshold, point 402 on the graph, then the speed governor 124 will be disabled. Typical values, although not the only values, for the high speed threshold and low speed threshold are 100% and zero percent of the speed throttle respectively. Other errors may be used when determining that the speed governor 124 should be disabled.

Transitioning from no speed governing to speed governing may be accomplished gradually or in a step-like manner depending upon the application requirements. In applications, such as the alternating current electrical generator type load 106, the speed governor 124 may be enabled from the time that the ECM 102 has completed initialization. Consequently, once engine 104 has started, it will be immediately commanded to the controlled speed as determined by the speed request signal.

Some applications require that speed governing be entered gradually. FIG. 4 shows a sample graph of engine speed as a function of the speed request signal. The speed governor 124 can be arranged so that once disabled, it cannot be enabled until the speed governor signal is in the enabled state and the speed request signal is below a initial threshold, point 404 on the graph. Here, the engine speed must be at, or slightly above idle before speed governing is enabled. Once enabled, the speed request signal may be increased, or decreased, to bring the engine 104 to the desired rotational speed. In any event, the engine 104 will be rotating at or near idle when speed governing is initiated.

Transitioning the speed governor 124 from disabled to enabled may also be made dependent upon the torque request signal. As with the speed request signal, enablement of the speed governor 124 may require the torque request signal to be below an initial torque threshold, point 502 in FIG. 5, prior to enabling a disabled speed governor 124. Initial torque threshold 502 is shown in this example slightly above engine idle. In alternative embodiments initial torque threshold 502 may be at a point that will result in engine idle. This approach is desired to be consistent with applications that allow the torque governor 118 to override the speed governor 124 when the torque request signal exceeds the high torque threshold 500. Enabling a disabled speed governor 124 only to have it immediately overrode by the torque governor 118 has the same effect as not enabling the speed governor 124.

In an alternative embodiment, transitioning the speed governor 124 from disabled to enabled may be made dependent upon both the torque request signal and the speed request signal. In this case, a disabled speed governor 124 may only be enabled if the speed governor signal is in the enabled state, the speed request signal is below the initial speed threshold, and the torque request signal is below the initial torque threshold.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An improved controller of an engine to force engine speed to idle even in the presence of a valid speed request, the controller having a torque governor and a speed governor that may be operational simultaneously, the improvement comprising:

a speed governor inhibit signal generated external to the controller and in communication with the speed governor, inhibit signal having an enabled state and a disabled state;

a speed request signal in communication with the speed governor; and the speed governor being operational to control a speed of the engine proportional to the speed request signal in response to the speed governor inhibit signal being in the enabled state, and the speed governor disabling and forcing engine speed to idle in response to the speed governor inhibit signal being in the disabled state.

2. The controller of claim 1 further comprising:

an initial speed threshold for the speed request signal; and the speed governor enabling only in response to the speed governor inhibit signal being in the enabled state and the speed request signal being below the initial speed threshold to provide smooth transitioning into speed governing.

3. The controller of claim 1 further comprising:

a low speed threshold for te speed request signal; and the speed governor disabling and forcing engine speed to idle in response to the speed request signal being below the low speed threshold and the speed governor inhibit signal being in the enabled state to prevent stalling the engine.

4. The controller of claim 1 further comprising:

a high speed threshold for the speed request signal; and the speed governor disabling and forcing engine speed to idle in response to the speed request signal exceeding the high speed threshold and the speed governor inhibit signal being in the enabled state to prevent an overspeed condition for the engine.

5. The controller of claim 1 further comprising:

a torque request signal in communication with the torque governor and the speed governor; and the torque governor being operational to control a torque produced by the engine proportional to the torque request signal.

6. The controller of claim 5 further comprising:

a high torque threshold for the torque request signal; and the speed governor disabling and forcing engine speed to idle in response to the torque request signal exceeding the high torque threshold to provide a requested torque from the engine.

7. The controller of claim 5 further comprising:

an initial torque threshold for the torque request signal; and the speed governor enabling only in response to the speed governor inhibit signal being in the enabled state and the torque request signal being below the initial torque threshold to provide smooth transitioning into speed governing.

8. The controller of claim 1 further comprising:

a speed request signal in communication with the speed governor;

a torque request signal in communication with the torque governor; and a conflict resolution scheme to determine how to use the speed request and the torque request signals to control the engine when both the speed governor and the torque governor inhibit signals are in the enabled state.

9. A method of operating a controller for an engine to force engine speed to idle even in the presence of a valid speed request, the controller having a torque governor and a speed governor that may be operated simultaneously, the method comprising:

monitoring a speed governor inhibit signal generate external to the controller, the speed governor inhibit signal having an enabled state and a disabled state;

monitoring a speed request signal;

controlling a speed of the engine proportional to the speed request signal in response to the speed governor signal being in the enabled state; and disabling the speed governor and forcing engine speed to idle in response to the speed governor inhibit signal being in the disabled state.

10. The method of claim 9 further comprising:

providing an initial speed threshold for the speed request signal; and enabling the speed governor only in response to the speed governor inhibit signal being in the enabled state and the speed request signal being below the initial speed threshold to provide smooth transitioning into speed governing.

11. The method of claim 9 further comprising:

providing a low speed threshold for the speed request signal; and disabling the speed governor and forcing engine speed to idle in response to the speed request signal being below the low speed threshold to prevent stalling the engine.

12. The method of claim 9 further comprising:

providing a high speed threshold for the speed request signal; and disabling the speed governor and forcing engine speed to idle in response to the speed request signal exceeding the high speed threshold to prevent an over-speed condition for the engine.

13. The method of claim 9 further comprising:

monitoring a torque request signal; and controlling a torque produced by the engine proportional to the torque request signal.

14. The method of claim 13 further comprising:

providing a high torque threshold for the torque request signal, and disabling the speed governor and forcing engine speed to idle in response to the torque request signal exceeding the high torque threshold to provide a requested torque from the engine.

15. The method of claim 12 further comprising:

providing an initial torque threshold for the torque request signal, and enabling the speed governor only in response to the speed governor inhibit signal being in the enabled state and the torque request signal being below the initial torque threshold to provide smooth transitioning into speed governing.

16. The method of claim 9 further comprising:

monitoring a torque request signal;

performing a conflict resolution prior to controlling the engine to determine how to use the speed request and the torque request signals to control the engine when both the speed governor and the torque governor inhibit signals are in the enabled state.

* * * * *

UNITED STATES PATENT AND TRADEMARK OFFICE

CERTIFICATE OF CORRECTION

PATENT NO. : 6,371,081 B1 
DATED : April 16, 2002
INVENTOR(S) : Jeffery Scott Hawkins, Richard Michael Avery, Jr. and Donald Michael McDonald It is certified that error appears in the above-identified patent and that said Letters Patent is hereby corrected as shown below:

Column 7,
Line 41, after "governor," please insert -- the speed governor --.

Signed and Sealed this

Ninth Day of July, 2002

*Attest:*

*Attesting Officer*

JAMES E. ROGAN
*Director of the United States Patent and Trademark Office*